US012558603B2

(12) United States Patent
Seidl et al.

(10) Patent No.: US 12,558,603 B2
(45) Date of Patent: Feb. 24, 2026

(54) SYSTEM AND METHOD FOR LIVE COUNTER-FACTUAL ANALYSIS IN TENNIS

(71) Applicant: STATS LLC, Chicago, IL (US)

(72) Inventors: Robert Seidl, Munich (DE); Christian Marko, Graz (AT); Patrick Joseph Lucey, Chicago, IL (US)

(73) Assignee: Stats LLC, Chicago, IL (US)

( * ) Notice: Subject to any disclaimer, the term of this patent is extended or adjusted under 35 U.S.C. 154(b) by 262 days.

(21) Appl. No.: 18/168,381

(22) Filed: Feb. 13, 2023

(65) Prior Publication Data

US 2023/0256318 A1 Aug. 17, 2023

Related U.S. Application Data

(60) Provisional application No. 63/267,964, filed on Feb. 14, 2022.

(51) Int. Cl.
*A63B 71/06* (2006.01)
*A63B 24/00* (2006.01)

(52) U.S. Cl.
CPC ..... *A63B 71/06* (2013.01); *A63B 24/0062* (2013.01)

(58) Field of Classification Search
None
See application file for complete search history.

(56) References Cited

U.S. PATENT DOCUMENTS

| | | | | |
|---|---|---|---|---|
| 11,679,299 | B2 * | 6/2023 | Power | A63B 24/0087 482/8 |
| 2009/0170584 | A1 | 7/2009 | Tan et al. | |
| 2014/0052678 | A1 | 2/2014 | Martinez et al. | |
| 2014/0236331 | A1 * | 8/2014 | Lehmann | G09B 19/0038 700/91 |
| 2016/0074739 | A1 | 3/2016 | Pisupati et al. | |
| 2020/0226204 | A1 * | 7/2020 | Avruskin | G07F 17/3244 |
| 2020/0230501 | A1 | 7/2020 | Schwartz et al. | |
| 2020/0279160 | A1 | 9/2020 | Holbrook et al. | |
| 2020/0349799 | A1 | 11/2020 | Amaitis et al. | |
| 2020/0387817 | A1 * | 12/2020 | Kurtz | G06F 18/251 |
| 2024/0087137 | A1 * | 3/2024 | Marty | G06T 7/70 |
| 2024/0303509 | A1 * | 9/2024 | Davis | G06F 17/18 |
| 2025/0068678 | A1 * | 2/2025 | Gallagher | G06F 16/9035 |

OTHER PUBLICATIONS

International Search Report and Written Opinion mailed on Jul. 26, 2023, issued in PCT/US23/62488, total 14 pages.

* cited by examiner

*Primary Examiner* — Ronald Laneau
(74) *Attorney, Agent, or Firm* — Bookoff McAndrews, PLLC

(57) ABSTRACT

A computing system identifies data related to a tennis match between a first player and a second player. The data includes a current match state and a current in-match performance. The computing system generates an input data set that includes the data related to the tennis match. The generating includes modifying the current match state to assume that the first player will win a next point in the tennis match. Based on the input data set, the computing system measures an importance of the next point to the first player winning the tennis match.

20 Claims, 13 Drawing Sheets

600

MOMENTUM

| PLAYER | POINTS WON FROM LAST 9 POINTS | POINT WIN % | PREVIOUS MOMENTUM | CURRENT MOMENTUM | SWING | NEXT POINT WIN% |
|---|---|---|---|---|---|---|
| WANG YAFAN | 2 | 22.22% | 6.50% | -6.11% | -12.60% | 41.05% |
| VEKIC DONNA | 7 | 77.78% | 6.50% | -6.11% | 12.60% | 58.95% |

FIG. 6

700

| PLAYER | clutchPointsPlayed | clutchPointsWon | clutchPointsWonPct | PointsPlayed | PointsWon | PointsWonPct | PointsWonPctDiff | WTA Ranking |
|---|---|---|---|---|---|---|---|---|
| ASHLEIGH BARTY | 849 | 470 | 55.36% | 6044 | 3194 | 52.85% | 2.51% | 1 |
| BIANCA ANDREESCU | 487 | 269 | 55.24% | 3211 | 1704 | 53.07% | 2.17% | 5 |
| NAOMI OSAKA | 528 | 287 | 54.36% | 4375 | 2339 | 53.46% | 0.89% | 3 |
| KAROLINA PLISKOVA | 913 | 478 | 52.35% | 6562 | 3480 | 53.03% | -0.68% | 2 |
| SIMONA HALEP | 524 | 260 | 49.62% | 4686 | 2462 | 52.54% | -2.92% | 4 |

FIG. 7

SYSTEM AND METHOD FOR LIVE COUNTER-FACTUAL ANALYSIS IN TENNIS

CROSS-REFERENCE TO RELATED APPLICATIONS

This application claims priority to U.S. Provisional Application Ser. No. 63/267,964, filed Feb. 14, 2022, which is hereby incorporated by reference in its entirety.

FIELD OF THE DISCLOSURE

The present disclosure generally relates to a system and method of live counter-factual analysis in tennis.

BACKGROUND

As the amount of data related to sports increases, teams, fans, and companies are increasingly more interested in fine-grained analysis of sporting events. While for some users, such as teams, coaches, and trainers, such metrics are critical to their team's or player's performance, other user's such as fans may utilize the information to engage in what-if discussions or debates regarding who is the best player of their generation or who is the best player in a certain category of statistics.

SUMMARY

In some embodiments, a method is disclosed herein. A computing system identifies data related to a tennis match between a first player and a second player. The data includes a current match state and a current in-match performance. The computing system generates an input data set that includes the data related to the tennis match. The generating includes modifying the current match state to assume that the first player will win a next point in the tennis match. Based on the input data set, the computing system measures an importance of the next point to the first player winning the tennis match by predicting, by the computing system, a first outcome of a current game based on the input data set, predicting, by the computing system, a second outcome of a current set based on the input data set and the predicted first outcome of the current game, predicting, by the computing system, a third outcome of the tennis match based on the input data set, the predicted first outcome of the current game, and the predicted second outcome of the current set.

In some embodiments, a non-transitory computer readable medium is disclosed herein. The non-transitory computer readable medium includes one or more sequences of instructions, which, when executed by a processor, causes a computing system to perform operations. The operations include identifying, by the computing system, data related to a tennis match between a first player and a second player. The data includes a current match state and a current in-match performance. The operations further include generating, by the computing system, an input data set that includes the data related to the tennis match. The generating includes modifying the current match state to assume that the first player will win a next point in the tennis match. The operations include, based on the input data set, measuring, by the computing system, an importance of the next point to the first player winning the tennis match by predicting, by the computing system, a first outcome of a current game based on the input data set, predicting, by the computing system, a second outcome of a current set based on the input data set and the predicted first outcome of the current game, and predicting, by the computing system, a third outcome of the tennis match based on the input data set, the predicted first outcome of the current game, and the predicted second outcome of the current set.

In some embodiments, a system is disclosed herein. The system includes a processor and a memory. The memory has programming instructions stored thereon, which, when executed by the processor, causes the system to perform operations. The operations include identifying data related to a tennis match between a first player and a second player. The data includes a current match state and a current in-match performance. The operations further include generating an input data set that includes the data related to the tennis match. The generating includes modifying the current match state to assume that the first player will win a next point in the tennis match. The operations include, based on the input data set, measuring an importance of the next point to the first player winning the tennis match by predicting a first outcome of a current game based on the input data set, predicting a second outcome of a current set based on the input data set and the predicted first outcome of the current game, and predicting a third outcome of the tennis match based on the input data set, the predicted first outcome of the current game, and the predicted second outcome of the current set.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrated only typical embodiments of this disclosure and are therefore not to be considered limiting of its scope, for the disclosure may admit to other equally effective embodiments.

FIG. 6 is a chart illustrating a key momentum swing at a critical point during a match, according to example embodiments.

FIG. 7 is a chart illustrating season-level performance of several players, according to example embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

A recent trend in machine learning is to utilize interpretable techniques such as counter-factual analysis to explain predictions of individual events. Such techniques are powerful in sports where it can be used to answer the impact of a play or event on the overall outcome of the match by framing it as a "what-if" question, where two predictions are conducted—the first based on one outcome, and the second on the alternative outcome. The differences in the prediction output may then be compared.

Such counter-factual analysis lends itself nicely to sports, such as tennis, where key moments like a break point occur often and can often decide the winner of the match. However, a limitation of such an approach is relying on a pre-defined notion of a key-moment only being a break point or game or set or match point. Instead, a key-moment could also include other points, which may depend on the relative strengths of the players as well as what has occurred already during the match (e.g., if a player is much stronger than another player, an early break point to the weaker player may not be important.)

Accordingly, one or more techniques described herein provide a counter-factual method for tennis that first automatically highlights the key moments in a match using "leverage", "clutch," and "momentum" metrics, which may be created by chaining counter-factual predictions which capture the importance of a point contributing to a player winning the set and/or match, or the likelihood of a comeback. Not only can the present approach highlight important moments before they occur in an automatic fashion (and not based on a pre-canned notion of what are important points such as break points), it can also link player behaviors at a season level which shines a light on their tendencies in key moments.

As those skilled in the art recognize, although the embodiments disclosed herein are discussed with specific attention to tennis, such techniques can be expanded to any sport, such as, but not limited to golf, baseball, basketball, soccer, and the like.

Figure 1:
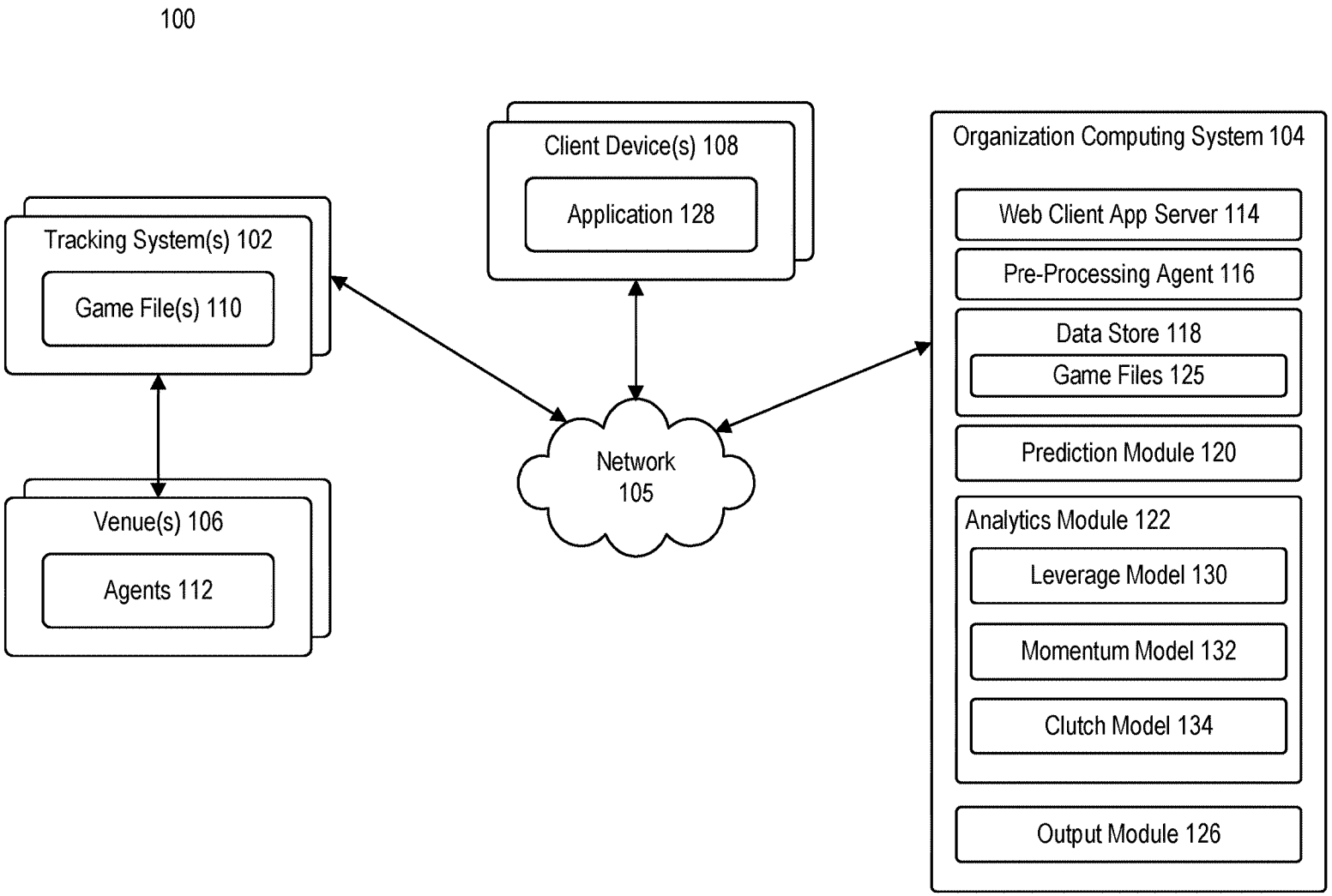
FIG. 1 is a block diagram illustrating a computing environment, according to example embodiments.

FIG. 1 is a block diagram illustrating a computing environment 100, according to example embodiments. Computing environment 100 may include tracking system 102, organization computing system 104, and one or more client devices 108 communicating via network 105.

Network 105 may be of any suitable type, including individual connections via the Internet, such as cellular or Wi-Fi networks. In some embodiments, network 105 may connect terminals, services, and mobile devices using direct connections, such as radio frequency identification (RFID), near-field communication (NFC), Bluetooth™, low-energy Bluetooth™ (BLE), Wi-Fi™ ZigBee™, ambient backscatter communication (ABC) protocols, USB, WAN, or LAN. Because the information transmitted may be personal or confidential, security concerns may dictate one or more of these types of connection be encrypted or otherwise secured. In some embodiments, however, the information being transmitted may be less personal, and therefore, the network connections may be selected for convenience over security.

Network 105 may include any type of computer networking arrangement used to exchange data or information. For example, network 105 may be the Internet, a private data network, virtual private network using a public network and/or other suitable connection(s) that enables components in computing environment 100 to send and receive information between the components of environment 100.

Tracking system 102 may be positioned in a venue 106. For example, venue 106 may be configured to host a sporting event that includes one or more agents 112. Tracking system 102 may be configured to capture the motions of all agents (i.e., players) on the playing surface, as well as one or more other objects of relevance (e.g., ball, referees, etc.). In some embodiments, tracking system 102 may be an optically-based system using, for example, a plurality of fixed cameras. For example, a system of six stationary, calibrated cameras, which project the three-dimensional locations of players and the ball onto a two-dimensional overhead view of the court may be used. In another example, a mix of stationary and non-stationary cameras may be used to capture motions of all agents on the playing surface as well as one or more objects or relevance. As those skilled in the art recognize, utilization of such tracking system (e.g., tracking system 102) may result in many different camera views of the court.

In some embodiments, tracking system 102 may be used for a broadcast feed of a given match. In such embodiments, each frame of the broadcast feed may be stored in a game file 110.

In some embodiments, game file 110 may further be augmented with other event information corresponding to event data, such as, but not limited to, game event information (fault, serve, ace, point, break point, game point, set point, etc.) and context information (game score, set score, match score, server, etc.).

Tracking system 102 may be configured to communicate with organization computing system 104 via network 105. In some embodiments, organization computing system 104 may receive, for example, data that may include human generated event data (providing organization computing system 104 with point by point information, or giving shot location information for every shot (or just the first and last shot)). In some embodiments, the data may be received from an in-venue tracking system, such as tracking system 102. In some embodiments, the data may be provided from a broadcast tracking system.

Organization computing system 104 may be configured to utilize counter-factual predictions to identify key points within a tennis match. Organization computing system 104 may include at least a web client application server 114, a pre-processing agent 116, data store 118, a prediction module 120, and an analytics module 122. Each of pre-processing agent 116, prediction module 120, and analytics module 122 may be comprised of one or more software modules. The one or more software modules may be collections of code or instructions stored on a media (e.g., memory of organization computing system 104) that represent a series of machine instructions (e.g., program code) that implements one or more algorithmic steps. Such machine instructions may be the actual computer code the processor of organization computing system 104 interprets to implement the instructions or, alternatively, may be a higher level of coding of the instructions that is interpreted to obtain the actual computer code. The one or more software modules may also include one or more hardware components. One or more aspects of an example algorithm may be performed by the hardware components (e.g., circuitry) itself, rather as a result of the instructions.

Data store 118 may be configured to store one or more game files 125. Each game file 125 may include data related to a given match. For example, a game file may include video data that includes a plurality of video frames captured by tracking system 102. In some embodiments, the video data may correspond to broadcast data of a given match, in which case, the video data may correspond to a plurality of video frames of the broadcast feed of a given match.

In some embodiments, each game file 125 may include event data related to a given match. For example, event data may refer to data that describes the various actions that take place during the match. Exemplary events or actions may include, but is not limited to, who serves, who defends, faults, points, break-points, match-points, and the like.

Pre-processing agent 116 may be configured to process data retrieved from data store 118. For example, pre-processing agent 116 may be configured to generate game files 125 stored in data store 118. For example, pre-processing agent 116 may be configured to generate a game file 125 based on data captured by tracking system 102. In some embodiments, pre-processing agent 116 may further be configured to store tracking data associated with each game in a respective game file 125. Tracking data may refer to the (x, y) coordinates of all players and balls on the playing surface during the game. In some embodiments, pre-processing agent 116 may receive tracking data directly from tracking system 102. In some embodiments, pre-processing agent 116 may derive tracking data from the broadcast feed of the game.

In some embodiments, pre-processing agent 116 may be configured to receive play-by-play data from one or more third party systems. For example, pre-processing agent 116 may receive a play-by-play feed corresponding to the broadcast video data. In some embodiments, the play-by-play data may be representative of human generated data based on events occurring within the game. Such play-by-play data may be stored in a corresponding game file 125.

Prediction module 120 may be configured to generate predictions for both the actual outcome of a point, game, set, and/or match and an alternative outcome of a point, game, set, and/or match. As those skilled in the art understand, tennis is a hierarchical game where winning points leads to winning games; winning games leads to winning sets; and winning sets leads to winning the match. The problem of predicting the winner of the next point, game, set, and match may be formulated as a multi-output model. Prediction module 120 may include four models that may be chained together to generate predictions on the point, game, set, and match levels. For example, the predicted point winner will affect the predicted game winner, which will affect the predicted set winner, which will affect the predicted match winner. Each model may generate a prediction in the order specified by the chain using all input features plus the prediction of the earlier model in the chain.

In some embodiments, prediction module 120 may further include a second suite of models trained to predict the final game, final set, and final match score.

Given these chained models, counter-factual analysis may be made possible by adapting the current features to an alternative future outcome. For example, what is the likelihood of winning the next point, next game, next set, and next match if the player of interest wins or loses the current point. Such analysis requires both very fast feature generation, model inference, and subsequent logic, which is notably absent from conventional counter-factual analysis systems.

As a tennis match evolves as a sequence of points, prediction module 120 may perform a counter-factual analysis by looking one step into the future of the match. Instead of merely predicting the winner at the current point, prediction module 120 may be trained to predict the most likely winner in the case that the next point ended in a win or loss of a player by using pre-processing agent 116 to update the current feature vectors and re-running prediction module 120.

Analytics module 122 may be configured to analyze the predictions generated by prediction module 120. For example, with the score and winner predictions of the two next match states, analytics module 122 may be configured to answer what-if questions before the actual point is played out. For example, before a break point is played, analytics module 122 may already tell how likely it will be that the player conceding the break will be able to win the set, reach a tiebreak, or win a tiebreak, which enables predictive analysis before the point of interest occurs.

A current short coming in tennis analytics (and sports analytics generally) is that most of the metrics are static and only related to predefined key moments. If, for example, a key insight is delivered which falls outside of the predefined templates, it is often reported in hindsight. Using a more specific example, after 10 points, it may be reported that a player has won 7 out of the last 10 points. Based on this criterium, this may be construed as the player gaining momentum. Although it is fine as a coarse barometer of short term match dominance, it will miss a lot of important moments as it is missing match (and player specific) contextual information.

For example, if a player is down 0-5 and wins 7 out of the last 10 points, the set-score would still be 1-5, and deuce in the current game which is not that interesting. In another example, a player may struggle to win her serve but then breaks the other serve to 15. None of this information is captured by simply counting points won.

Analytics module 122 may be configured to identify hand-crafted metrics (e.g., leverage, momentum, and clutch) based on the predictions generated by prediction module 120. For example, in some embodiments, prediction module 120 may include leverage model 130, momentum model 132, and clutch model 134.

Leverage model 130 may be configured to measure the importance of a particular point, play, or portion of a sporting event. Leverage may be defined as measuring the magnitude of how the win probability will change as a result of either winning or losing the point. For example, using the counter-factual prediction framework of prediction module 120, leverage model 130 may determine leverage by using the current game-context and then adding the future state of a player winning or losing the next point and measuring the difference between the two. This allows leverage model 130 to objectively measure the importance of a point, which may take into consideration the current match context and the relative player strength.

Momentum model 132 may be configured to measure a momentum of a player or a team at a particular point in a game. In some embodiments, momentum model 132 may be configured to estimate the current momentum of a player, multiple players, or a team based on output from leverage model 130 players.

Momentum may be defined as an exponentially weighted moving average of the leverage gained by a player. Mathematically, momentum may be represented as:

$$y_t = \frac{\left(x_t + (1-\alpha)x_{t-1} + (1-\alpha)^2 x_{t-2} + \ldots + (1-\alpha)^t x_0\right)}{1 + (1-\alpha) + (1-\alpha)^2 + \ldots + (1-\alpha)^t}$$

where $[x_0, x_1, \ldots, x_t]$ are the gained leverages of the last t points, $\alpha$ represents a smoothing factor, and $y_t$ represents the momentum at point t. In some embodiments $\alpha$=0.33; however, in some embodiments, $\alpha$ may be greater than or less than 0.33. At a high level, setting $\alpha$=0.33 may mean that a player may be attributed the leverage/importance of a point when she wins it and it is reduced when she loses it; moreover, the latest points may be weighted more heavily in the momentum equation.

Accordingly, in this manner, momentum model 132 may generate or measure a momentum of a player or a team based the leverage information.

Clutch model 134 may be configured to measure a clutchness of player, player, or team. Clutch may be defined as an important point in the match where winning or losing the point has a significant effect on the current match win probability. In some embodiments, a point may be referred to as clutch when its leverage exceeds 10%.

As those skilled in the art understand, a limitation of current tennis metrics is that they are very simple and rigid. Break points, for example, are by definition important, as a player cannot win a set without a break. The more break points a player wins, the more dominant the player is given that the player holds server. Game points on a player's own serve are considered less important than break points but more important than all other points because the player is only one point away from winning the game. In the present case, the importance of winning this point for winning the match in the end may be ignored. As a result, key points cannot be pre-defined and are heavily contextual. Therefore, a metric is needed which can capture the in-game context to highlight the key points before those points are played. These points may be referred to as "clutch points." Accordingly, clutch model 134 may be configured to generate clutch points based on, for example, the momentum determined by momentum model 132.

In some embodiments, organization computing system 104 may include output module 126. Output module 126 may be configured to generate one or more outputs that illustrate outputs generated by prediction module 120 and/or analytics module 122. For example, output module 126 may generate an output that illustrates the evolution of win probabilities of both players in a match from the beginning of the match.

Client device 108 may be in communication with organization computing system 104 via network 105. Client device 108 may be operated by a user. For example, client device 108 may be a mobile device, a tablet, a desktop computer, a set-top box, a streaming player, or any computing system capable of receiving, rendering, and presenting video data to the user. Users may include, but are not limited to, individuals such as, for example, subscribers, clients, prospective clients, or customers of an entity associated with organization computing system 104, such as individuals who have obtained, will obtain, or may obtain a product, service, or consultation from an entity associated with organization computing system 104.

Client device 108 may include at least application 128. Application 128 may be representative of a web browser that allows access to a web site or a stand-alone application. Client device 108 may access application 128 to access one or more functionalities of organization computing system 104. Client device 108 may communicate over network 105 to request a webpage, for example, from web client application server 114 of organization computing system 104. For example, client device 108 may be configured to execute application 128 to access one or more predictions generated by prediction module 120 and/or analytics generated by analytics module 122. The content that is displayed to client device 108 may be transmitted from web client application server 114 to client device 108, and subsequently processed by application 128 for display through a graphical user interface (GUI) of client device 108.

Figure 2:
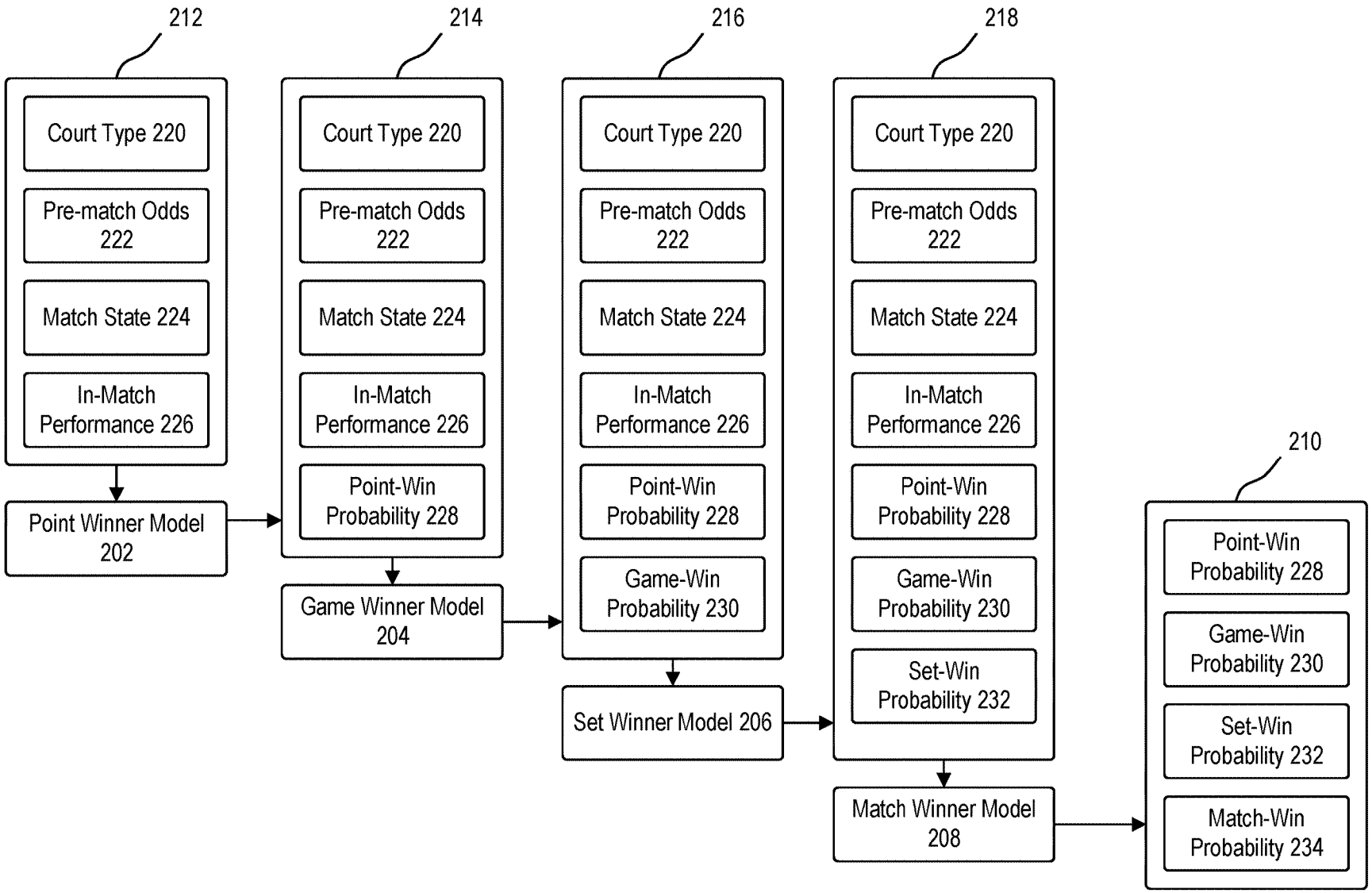
FIG. 2 is a block diagram illustrating predictive models of the prediction module of FIG. 1, according to example embodiments.

FIG. 2 is a block diagram illustrating the predictive models of prediction module 120, according to example embodiments. As shown, prediction module 120 may include point winner model 202, game winner model 204, set winner model 206, and match winner model 208. In some embodiments, each of point winner model 202, game winner model 204, set winner model 206, and match winner model 208 may take the form of a gradient boosting tree model.

Point winner model 202 may be configured to predict whether a player will win the next point based on various inputs 212. As shown, inputs 212 may include court type 220 (e.g., grass, clay, hard), pre-match odds 222, and match state 224 (e.g., current game and set score), in-match statistics 226 (e.g., difference in points won, games won, breaks won in the current game, set, and match, serve percentages, return percentages, etc.). Such inputs 212 may be generated by pre-processing agent 116. Point winner model 202 may be trained to predict the outcome of the next point based on inputs 212. For example, the output from point winner model 202 may be a point-win probability 228, which provides a probability of the player winning the next point.

Game winner model 204 may be configured to predict whether the player will win the current game and/or the next game based on various inputs 214. As shown, inputs 214 may be similar to inputs 212. For example, inputs 214 may similarly include court type 220, pre-match odds 222, match state 224, and in-match statistics 226. However, because game winner model 204 is downstream of point winner model in the chain of models, inputs 214 may also include the output from point winner model 202, i.e., point-win probability 228. Such inputs 214 may be generated by pre-processing agent 116. Game winner model 204 may be trained to predict the outcome of the game based on inputs 214. For example, the output from game winner model 204 may be a game-win probability 230, which provides a probability of the player winning the game.

Set winner model 206 may be configured to predict whether the player will win the current set and/or the next set based on various inputs 216. As shown, inputs 216 may be similar to inputs 214. For example, inputs 216 may similarly include court type 220, pre-match odds 222, match state 224, and in-match statistics 226. However, because set winner model 206 is downstream of point winner model 202 and game winner model 204 in the chain of models, inputs 216 may also include the output from point winner model 202, i.e., point-win probability 228, and the output from game winner model 204, i.e., game-win probability 230. Such inputs 214 may be generated by pre-processing agent 116. Set winner model 206 may be trained to predict the outcome of the set based on inputs 216. For example, the output from set winner model 206 may be a set-win probability 232, which provides a probability of the player winning the set.

Match winner model 208 may be configured to predict whether the player will win the current match and/or the next match based on various inputs 218. As shown, inputs 218 may be similar to inputs 216. For example, inputs 218 may similarly include court type 220, pre-match odds 222, match state 224, and in-match statistics 226. However, because match winner model 208 is downstream of point winner model 202, game winner model 204, and set winner model 206 in the chain of models, inputs 218 may also include the output from point winner model 202, i.e., point-win probability 228, the output from game winner model 204, i.e., game-win probability 230, and the output from set winner model 206, i.e., set-win probability 232. Such inputs 218 may be generated by pre-processing agent 116. Match winner model 208 may be trained to predict the outcome of the set based on inputs 218. For example, the output from match winner model 208 may be a match-win probability 234, which provides a probability of the player winning the match.

As shown, as output, prediction module 120 may generate outputs 210. Outputs 210 may include point-win probability 228, game-win probability 230, set-win probability 232, and match-win probability 234.

As recited above, as part of inputs 212-218, such as match state 224, pre-processing agent 116 may make an assumption regarding the outcome of a point and may provide that assumption as part of inputs 212-218. For example, assume first that pre-processing agent 116 makes an assumption that Player A will win the current point. Pre-processing agent 116 may update inputs 212-218 with that assumption and prediction module 120 may generate outputs 210 based on the assumption that Player A will win the current point. Next, pre-processing agent 116 may make an assumption that Player B will lose the current point. Pre-processing agent 116 may update inputs 212-218 with that assumption and prediction module 120 may generate outputs 210 based on the assumption that Player B will win the current point. Such outputs may allow for analytics module 122 to perform a counter-factual analysis.

Figure 3:
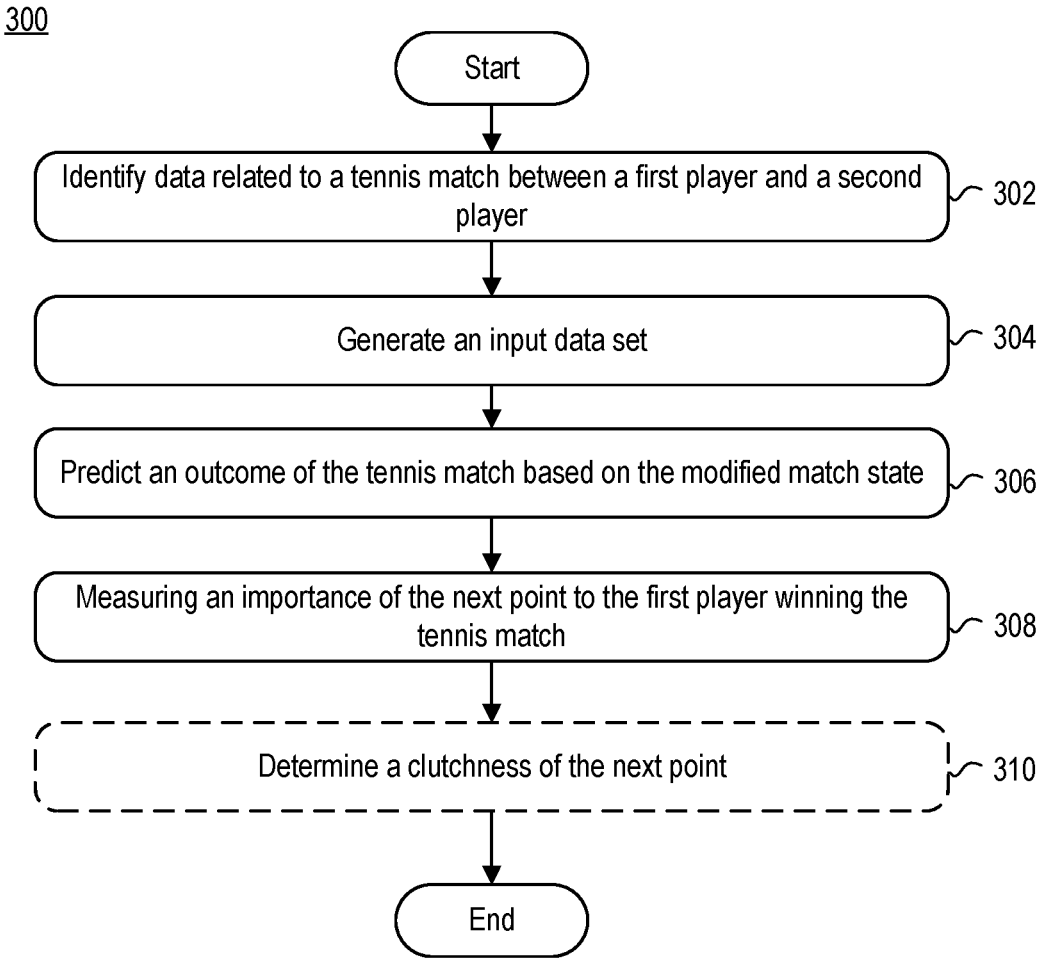
FIG. 3 is a flow diagram illustrating a method of determining a player's leverage in a tennis match, according to example embodiments.

FIG. 3 is a flow diagram illustrating a method 300 of determining a player's leverage in a tennis match, according to example embodiments. Method 300 may begin at step 302.

At step 302, organization computing system 104 may identify data related to a tennis match between a first player and a second player. In some embodiments, the data may include a current match state. For example, the current match state may include information such as, but not limited to, current game and set score. In some embodiments, the data may further include player strength information. For example, the data may include a relative strength of the first player and a relative strength of the second player. In some embodiments, the relative strength may be reflective of each player's ranking in the tournament or league.

At step 304, organization computing system 104 may generate an input data set based on the identified data and current match state. For example, pre-processing agent 116 may generate an input data set that includes the current match state (e.g., current game score, current set score, etc.) and relative strength of each player. In some embodiments, as part of generating the input data set, pre-processing agent 116 may modify the current match state. For example, pre-processing agent 116 may modify the current match state by assuming the first player (or the second player) will win a next point.

At step 306, organization computing system 104 may predict an outcome of the tennis match based on the input data set and the modified match state. For example, pre-processing agent 116 may provide the input data set, as input, to prediction module 120. Prediction module 120 may use the input data set and modified match state to predict a game winner using game winner model 204. In some embodiments, prediction module 120 may use output from the game winner model 204 to generate a set winner prediction using set winner model 206. In some embodiments, prediction module 120 may use output from set winner model 206 to generate a predicted match winner using match winner model 208. Accordingly, prediction module 120 may use the input data set and modified match state to predict the first player's game win probability, set-win probability, and match-win probability if the first player wins the next point, as stipulated.

As those skilled in the art understand, such modification of the game state can be performed at any level. For example, rather than modify the current match state to assume the first player will win the next point, pre-processing agent 116 may modify the current match state to assume the first player will win the next set.

At step 308, organization computing system 104 may measure an importance of the next point. In some embodiments, analytics module 122 may generate an importance of the first player winning the next point to the first player winning the current set. In some embodiments, analytics module 122 may generate an importance of the first player winning the next point to the first player winning the current game. In some embodiments, analytics module 122 may generate an importance of the first player winning the next point to the first player winning the match. Accordingly, leverage model 130 may generate a player's leverage for the next point. The player's leverage may be defined as the magnitude of how the win probability (e.g., game, set, or match) will change as a result of the first player winning the next point (or losing the next point).

In some embodiments, method 300 may include step 310. At step 310, organization computing system 104 may determine a clutchness value of the next point. For example, clutch model 134 may analyze the player's leverage generated in step 308 to determine whether the next point has a significant effect on the current win probability (e.g., game, set, or match). For example, if clutch model 134 determines that the player's leverage for the next point exceeds a threshold percentage (e.g., 10%), then clutch model 134 may determine that the next point is a clutch point. The more clutch points a player wins, the more clutch that player may be considered.

Figure 4:
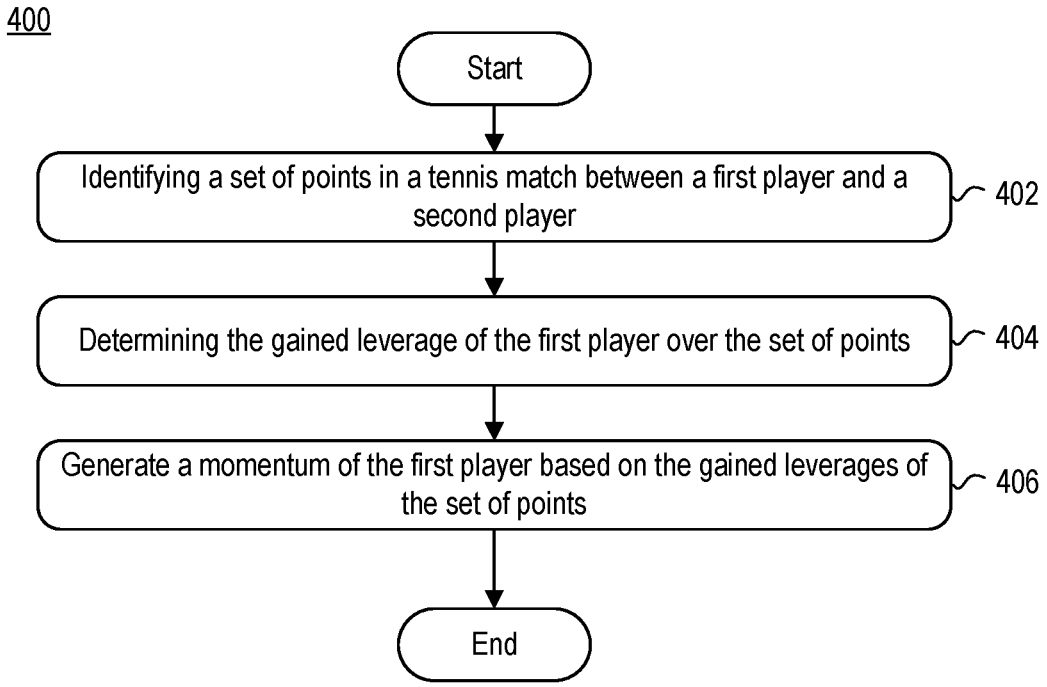
FIG. 4 is a flow diagram illustrating a method of determining a player's momentum in a tennis match, according to example embodiments.

FIG. 4 is a flow diagram illustrating a method 400 of determining a player's momentum in a tennis match, according to example embodiments. Method 400 may begin at step 402.

At step 402, organization computing system 104 may identify a set of points in a tennis match between the first player and the second player. For example, analytics module 122 may identify a set of t points up to time t.

At step 404, organization computing system 104 may determine a gained leverage of the first player over the set of points. For example, for each point in the set of t points, analytics module 122 may generate a leverage based on the techniques discussed above in conjunction with FIG. 3. As output, analytics module 122 may generate a set of gained leverages $[x_0, x_1, \ldots x_t]$ over the last t points.

At step 406, organization computing system 104 may generate a momentum of the first player based on the gained leverages. For example, momentum model 132 may generate an exponentially weighted moving average of the leverage gained by the player. The exponentially weighted moving average may represent or capture the momentum of the first player. Mathematically, this may be expressed as:

$$y_t = \frac{\left(x_t + (1-\alpha)x_{t-1} + (1-\alpha)^2 x_{t-2} + \ldots + (1-\alpha)^t x_0\right)}{1 + (1-\alpha) + (1-\alpha)^2 + \ldots + (1-\alpha)^t}$$

where $[x_0, x_1, \ldots, x_t]$ are the gained leverages of the last t points, $\alpha$ represents a smoothing factor, and $y_t$ represents the momentum at point t.

Figure 5:
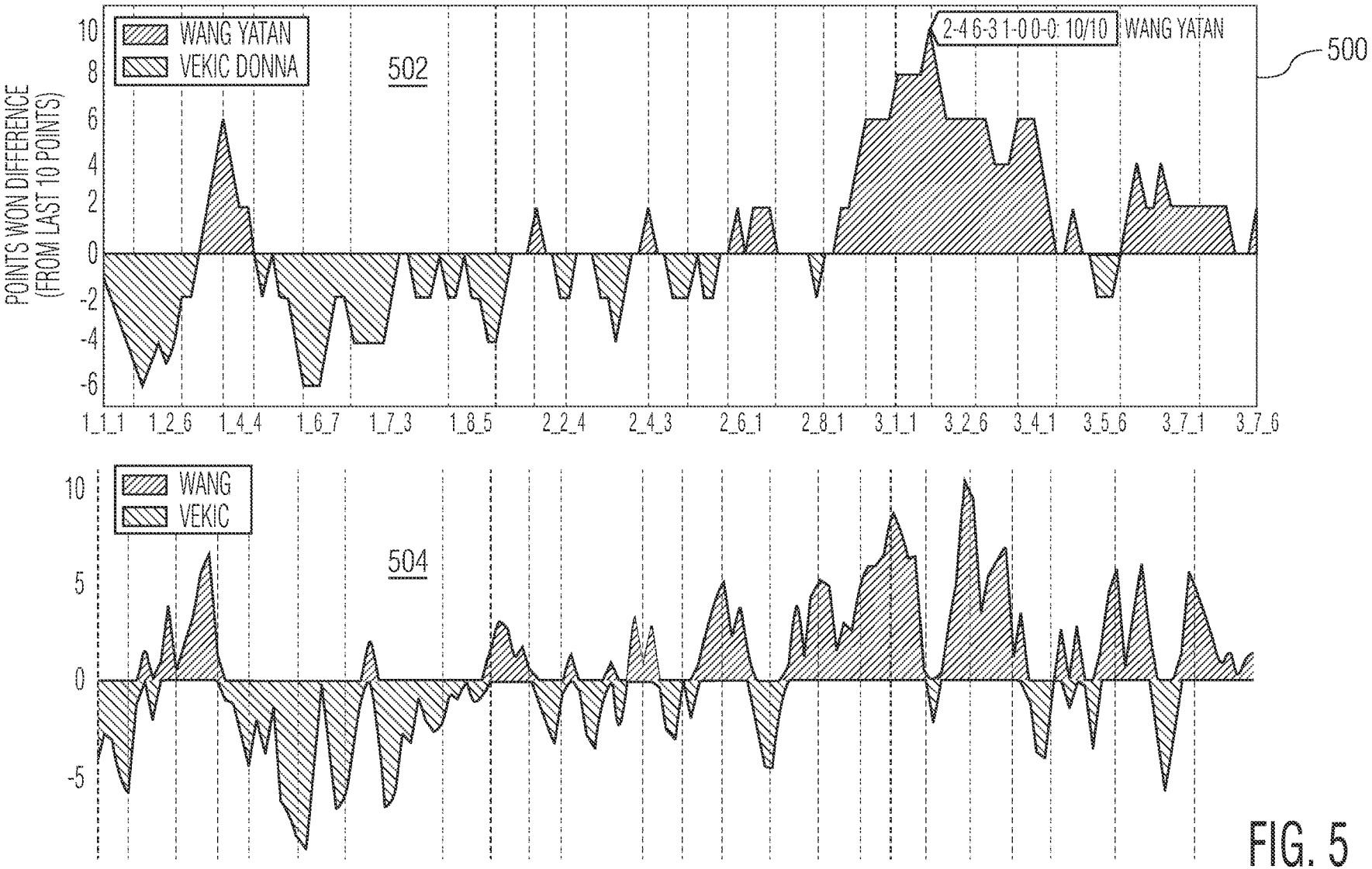
FIG. 5 is a chart illustrating player momentum during a match between two players, according to example embodiments.

FIG. 5 is a chart 500 illustrating player momentum during a match between two players, according to example embodiments.

Chart 500 may include a top section 502 and a bottom section 504. Top section 502 may illustrate a counting of the consecutive points won; bottom section 504 may illustrate the contextually weighted estimate using counter-factual predictions generated by analytics module 122. A positive value may indicate that Wang won more than give out of the last ten points and a negative value may favor Vekic. As shown, a negative value may favor Vekic. Highlighted in chart 500 is the point when Wang went on a run and wins 10 points in a row to win the second set 6-3 and is up 1-0 in the final third set.

FIG. 6 is a chart 600 illustrating a key momentum swing at a critical point during a match, according to example embodiments.

As shown, chart 600 captures what is considered a strong momentum swing. In some embodiments, analytics module 122 may identify the momentum change looking back 8-12 points. If, for example, a threshold of 3% was reached, and there was a zero crossing and the threshold was reached for the other player, analytics module 122 may conclude that the momentum changed. Using this trigger, analytics module 122 can also report on other interesting insights, such as the points won metric in this interval and also what prediction module 120 thinks who will win the next point.

FIG. 7 is a chart 700 illustrating season-level performance of several players, according to example embodiments.

In some embodiments, in addition to analytics module 122 leveraging the counter-factual prediction framework to create dynamic metrics that can be used to enhance the story-telling aspects of a game within a single tennis match, analytics module 122 may further be able to capture the season-long behaviors of players, which can describe their emerging behaviors. Given the leverage, momentum and clutch metrics on a point-level, analytics module 122 can aggregate these metrics to generate insights into the season-level performance of players. Often player performance is measured in how many points a player was able to win, how many break points a player created or conceded and how many of these she converted. Again, as break points are all weighted equally this does not tell the whole story. The foregoing definition of clutch points may be used by analytics module 122 to find, for example, the player who handled these important points the best.

Chart 700 illustrates the individual performance of the top five ranked players at the end of 2019 in terms of points won and clutch points won 2019. As shown, the world number one player, Ashleigh Barty, did not have the highest points won percentage (52.85%) but she did win 55.36% (+2.51%) of all her clutch points, which made her the strongest clutch player in 2019. In contrast, Simona Halep performed equally well in terms of points won percentage (52.54%) but only won 49.62% (−2.92%) of her clutch points.

Figure 8:
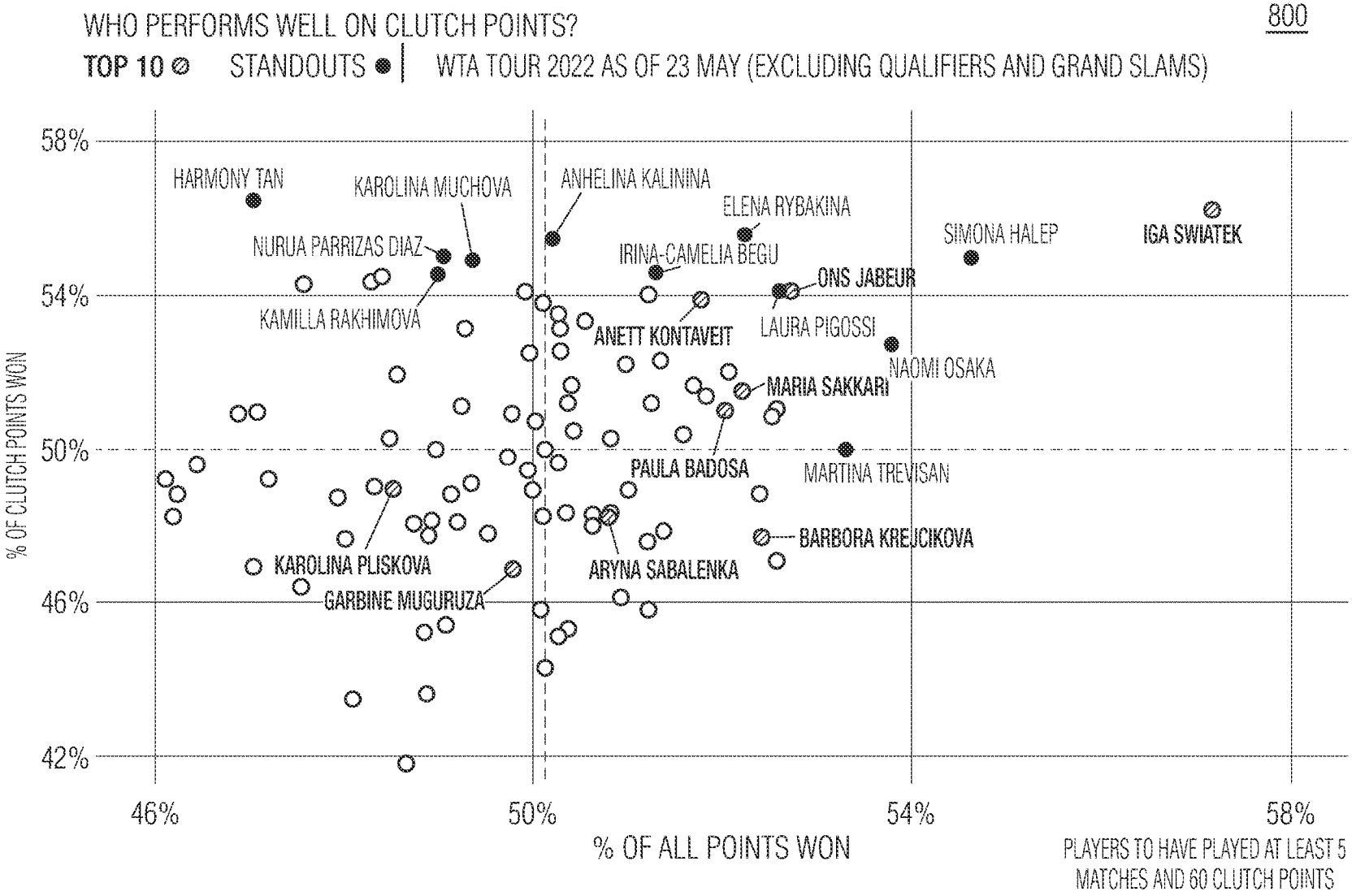
FIG. 8 is a chart illustrating a cluster analysis of all players in the World Tennis Association (WTA), according to example embodiments.

FIG. 8 is a chart 800 illustrating a cluster analysis of all players in the 2022 World Tennis Association (WTA), according to example embodiments. Chart 800 may provide an indication of which players in the WTA were most clutch in 2022. As shown, chart 800 may illustrate a comparison between those players that were most clutch and those players that were in the top 10 rankings.

This analysis could also provide an indication of future emerging stars who played clutch points well but did not finish the year or are not currently in the Top 10. In some situations, having a low number of clutch points in a match or season can be a strong indication of dominance. In some situations, if a player has a match with many clutch points, that is a strong indicator of an exciting match which can be used as a barometer to draw viewers' attention during the game live, or highlight as a must re-watch game.

Figure 9:
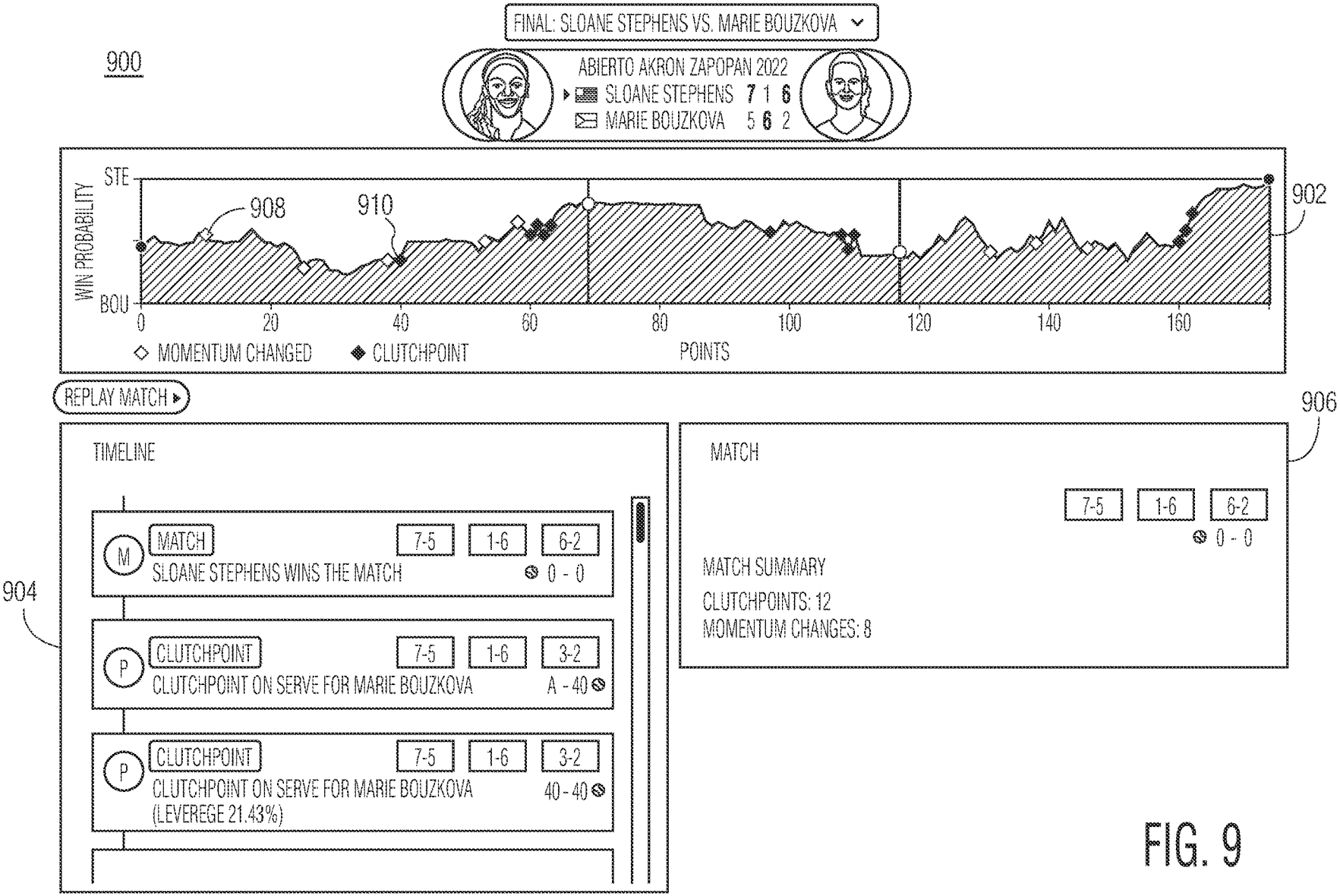
FIG. 9 illustrates one or more graphical outputs, according to example embodiments.

FIG. 9 illustrates a graphical output 900, according to example embodiments. As shown, graphical output 900 may include a representation of a match between two players. Graphical output 900 may include a win probability portion 902, a timeline 904, and a match summary 906. Win probability portion 902 may graphically represent each player's win probability over the course of a game. In some embodiments, win probability portion 902 may include outputs generated by analytics module 122. For example, win probability portion 902 may include one or more indicators 908 and one or more indicators 910. Indicators 908 may correspond to changes in momentum, as determined by momentum model 132. Indicators 910 may correspond to clutch points, as determined by clutch model 134.

Timeline 904 may include events that occur during the course of an event. In some embodiments, timeline 904 may include indicators of clutch points and momentum. In some embodiments, if a user clicks on an event in timeline 904, graphical output 900 may be updated to include a video corresponding to the key moment. For example, as shown, for the clutch point on the serve for Marie Bouzkova, if a user clicks on the corresponding event in timeline 904, output module 126 may provide the user with a video corresponding to that serve.

Figure 10:
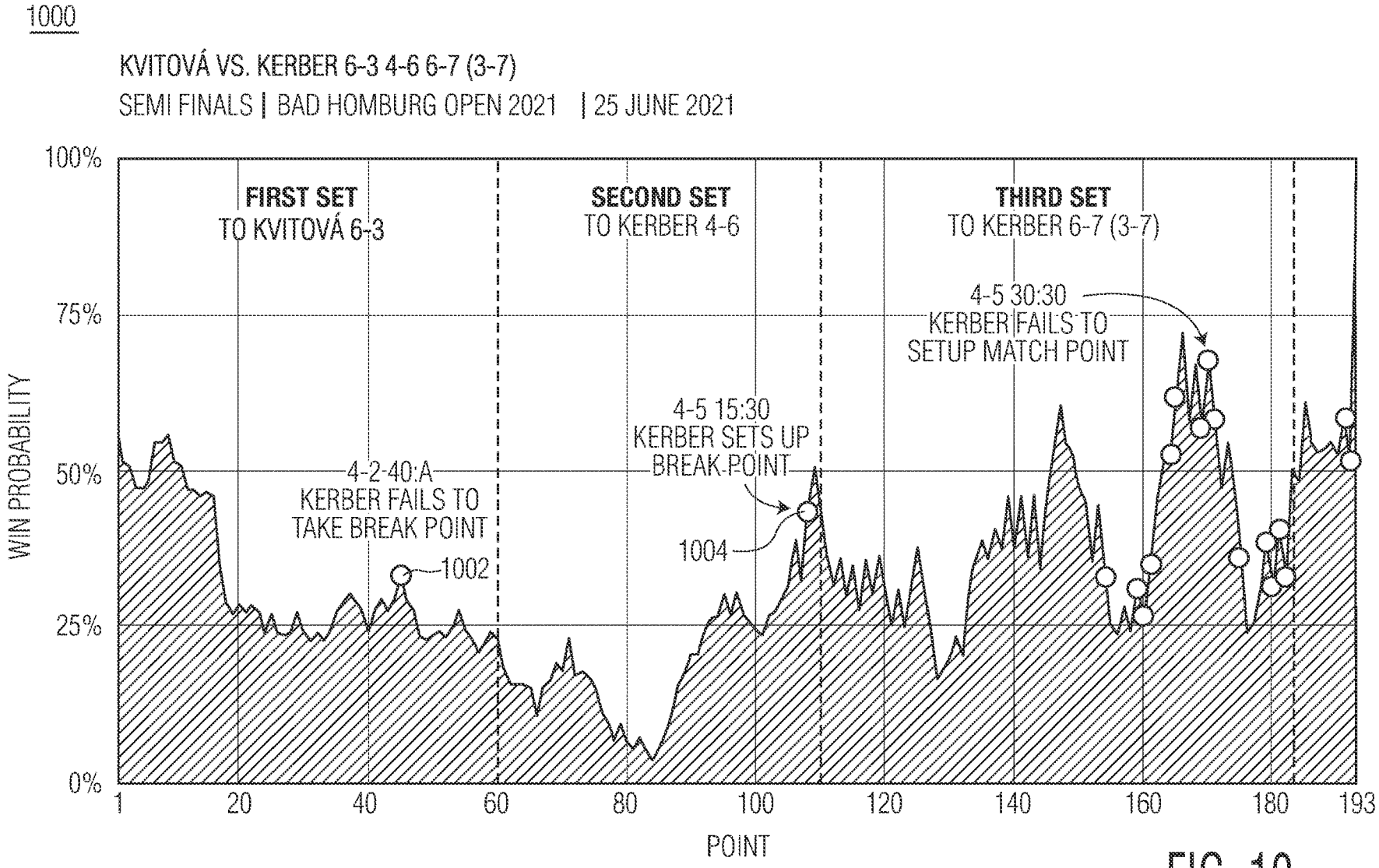
FIG. 10 illustrates one or more graphical outputs, according to example embodiments.

FIG. 10 illustrates a graphical output 1000, according to example embodiments. As shown, graphical output 1000 may be representative of the win probability for each player in a tennis match. In some embodiments, graphical output 1000 may include indicator 1002 and indicator 1004. Each of indicator 1002 and indicators 1004 may correspond to more exciting portions of the match. For example, as shown indicator 1002 may correspond to a break point failure. Similarly, indicator 1004 may indicate a set up for a break-point.

Figure 11A:
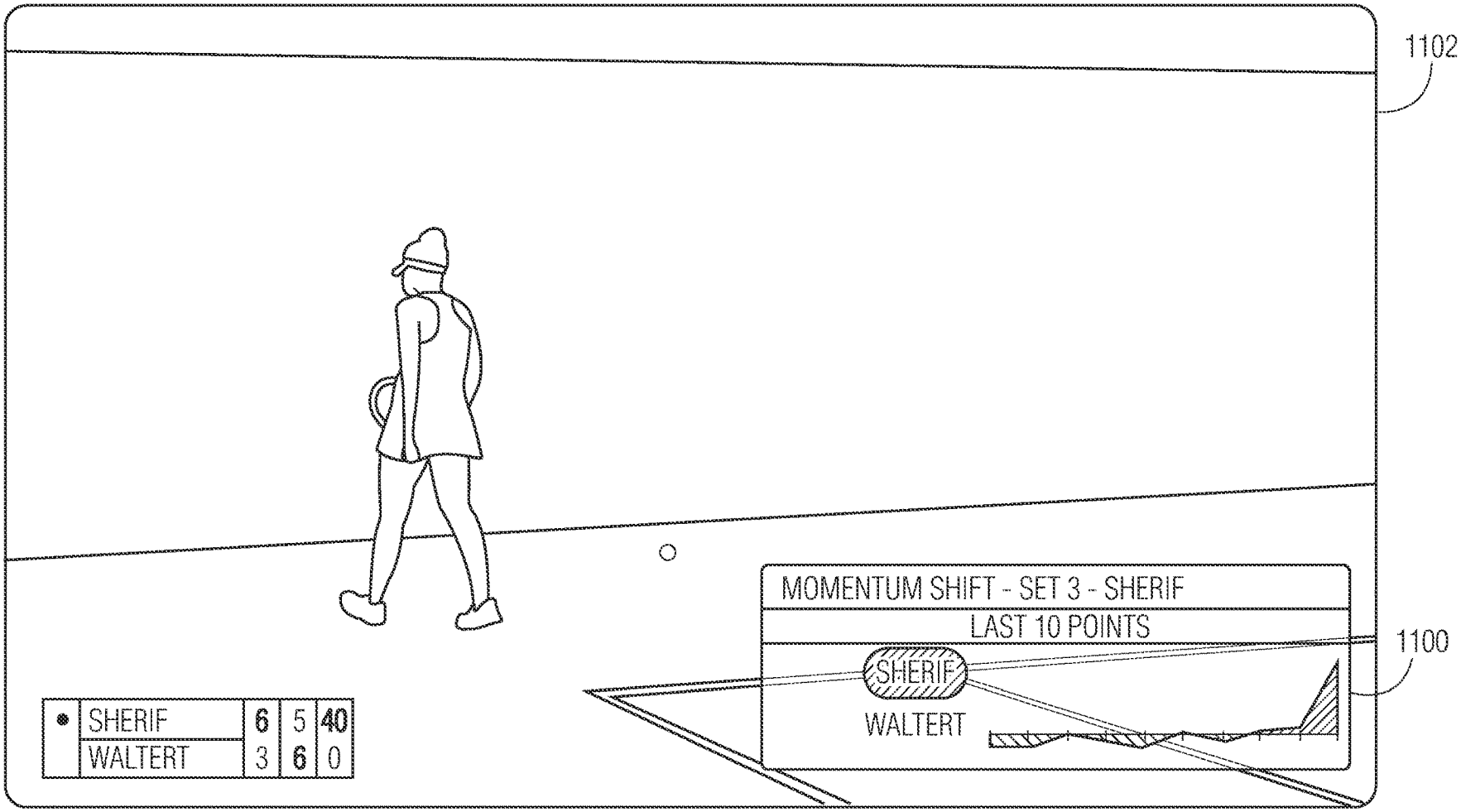
FIG. 11A illustrates one or more graphical outputs, according to example embodiments.

FIG. 11A illustrates a graphical output 1100, according to example embodiments. As shown, graphical output 1100 may take the form of an overlay on a broadcast video stream 1102. For example, as shown, graphical output 1100 may indicate a momentum shift between the two players of a tennis match.

Figure 11B:
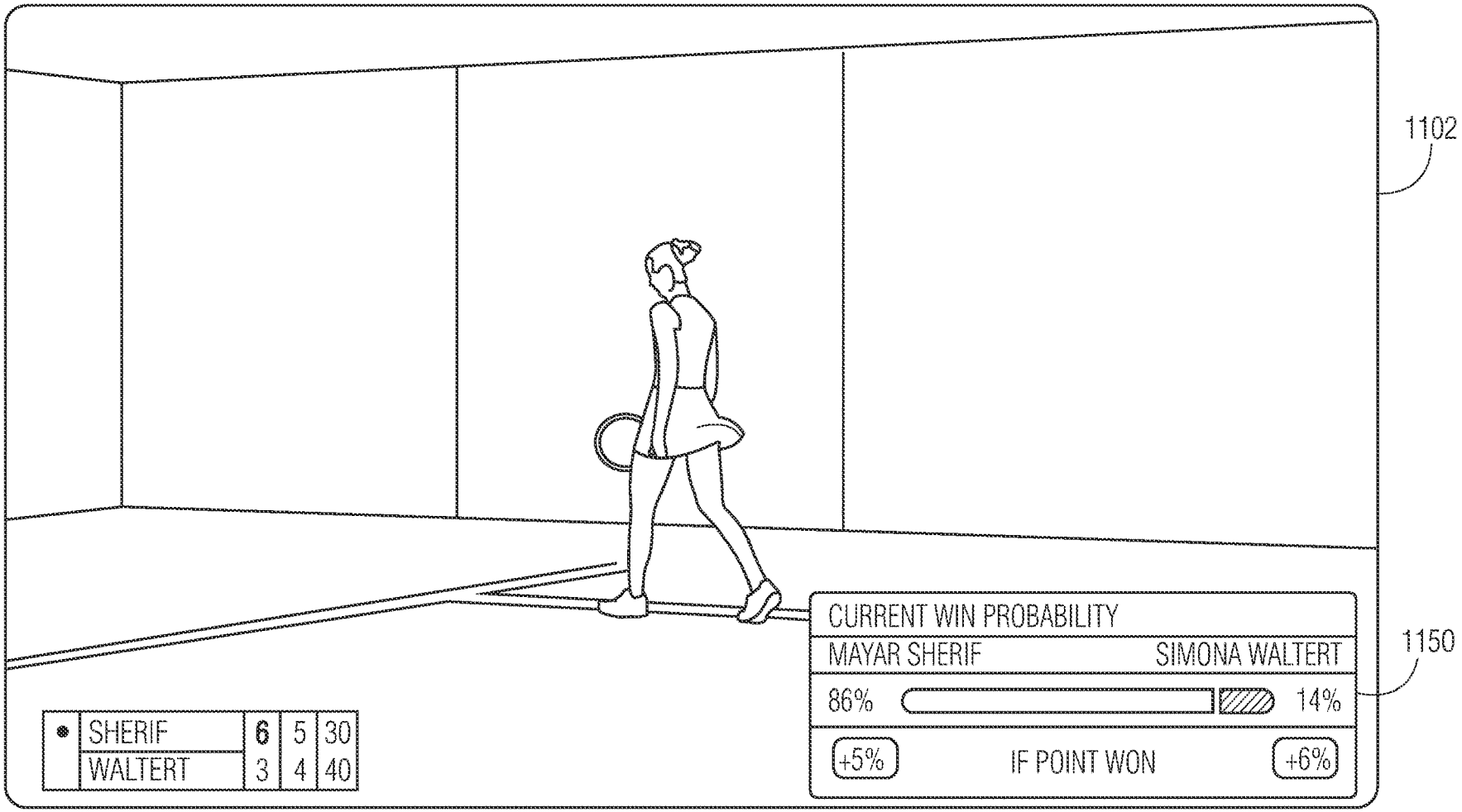
FIG. 11B illustrates one or more graphical outputs, according to example embodiments.

FIG. 11B illustrates a graphical output 1150, according to example embodiments. As shown, graphical output 1150 may take the form of an overlay on broadcast video stream 1102. For example, as shown, graphical output 1150 may include a current win probability of each player in the tennis match.

More generally, output module 126 may be configured to generate various graphical representations. For example, output module 126 may be configured to generate graphical representations that depict or include information regarding the current win probabilities, clutch moments, or momentum of the players. In some embodiments, output module 126 may be configured to generate graphical representations that include non-artificial intelligence driven metrics. For example, output module 126 may generate graphical representations that include information such as forehand winner, backhand winner, and the like. Such graphical representations may be visually displayed over a current video feed of the match.

In some embodiments, output module 126 may generate these graphical representations responsive to certain trigger events. For example, if analytics model 122 determines that a moment in the match was a key moment in the match, output module 126 may be triggered to generate a graphical representation that includes a description of the importance of the next point. Similarly, if a moment in the match changes the current win probability of a player or momentum of a player, output module 126 may be triggered to generate a graphical representation that includes a description of this change.

Figure 12A:
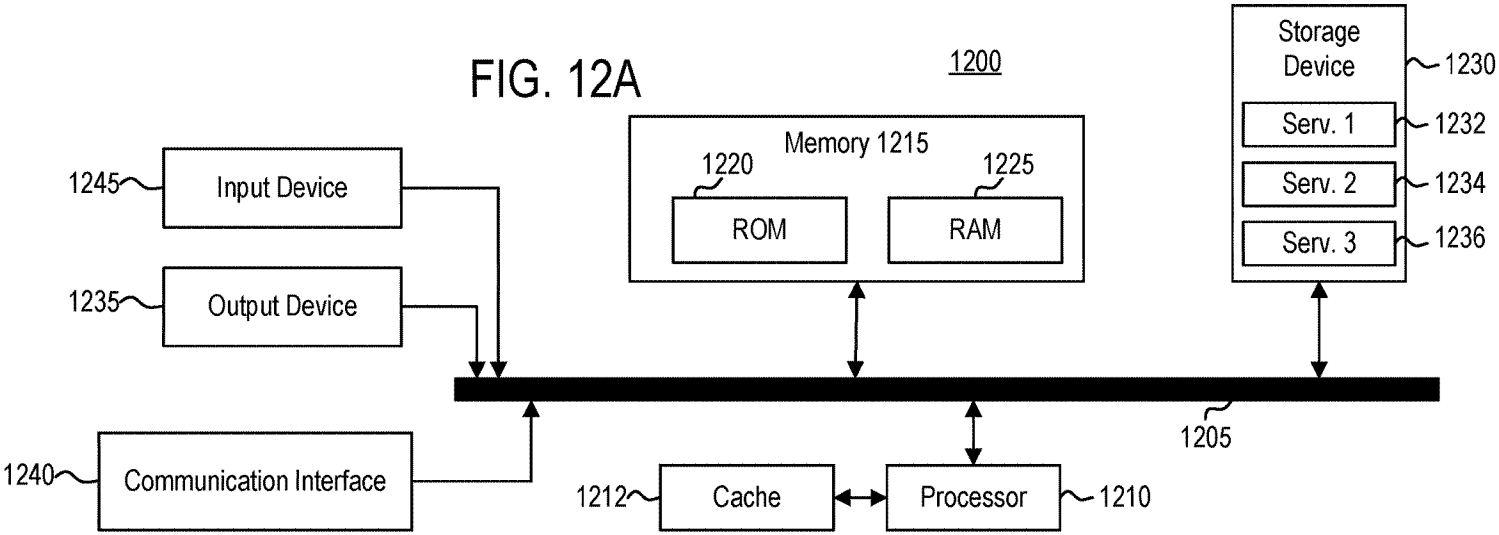
FIG. 12A illustrates an architecture of a computing system, according to example embodiments.

FIG. 12A illustrates an architecture of computing system 1200, according to example embodiments. System 1200 may be representative of at least a portion of organization computing system 104. One or more components of system 1200 may be in electrical communication with each other using a bus 1205. System 1200 may include a processing unit (CPU or processor) 1210 and a system bus 1205 that couples various system components including the system memory 1215, such as read only memory (ROM) 1220 and random access memory (RAM) 1225, to processor 1210. System 1200 may include a cache of high-speed memory connected directly with, in close proximity to, or integrated as part of processor 1210. System 1200 may copy data from memory 1215 and/or storage device 1230 to cache 1212 for quick access by processor 1210. In this way, cache 1212 may provide a performance boost that avoids processor 1210 delays while waiting for data. These and other modules may control or be configured to control processor 1210 to perform various actions. Other system memory 1215 may be available for use as well. Memory 1215 may include multiple different types of memory with different performance characteristics. Processor 1210 may include any general purpose processor and a hardware module or software module, such as service 1 1232, service 2 1234, and service 3 1236 stored in storage device 1230, configured to control processor 1210 as well as a special-purpose processor where software instructions are incorporated into the actual processor design. Processor 1210 may essentially be a completely self-contained computing system, containing multiple cores or processors, a bus, memory controller, cache, etc. A multi-core processor may be symmetric or asymmetric.

To enable user interaction with the computing system 1200, an input device 1245 may represent any number of input mechanisms, such as a microphone for speech, a touch-sensitive screen for gesture or graphical input, keyboard, mouse, motion input, speech and so forth. An output device 1235 (e.g., display) may also be one or more of a number of output mechanisms known to those of skill in the art. In some instances, multimodal systems may enable a user to provide multiple types of input to communicate with computing system 1200. Communications interface 1240 may generally govern and manage the user input and system output. There is no restriction on operating on any particular hardware arrangement and therefore the basic features here may easily be substituted for improved hardware or firmware arrangements as they are developed.

Storage device 1230 may be a non-volatile memory and may be a hard disk or other types of computer readable media which may store data that are accessible by a computer, such as magnetic cassettes, flash memory cards, solid state memory devices, digital versatile disks, cartridges, random access memories (RAMs) 1225, read only memory (ROM) 1220, and hybrids thereof.

Storage device 1230 may include services 1232, 1234, and 1236 for controlling the processor 1210. Other hardware or software modules are contemplated. Storage device 1230 may be connected to system bus 1205. In one aspect, a hardware module that performs a particular function may include the software component stored in a computer-readable medium in connection with the necessary hardware components, such as processor 1210, bus 1205, output device 1235, and so forth, to carry out the function.

Figure 12B:
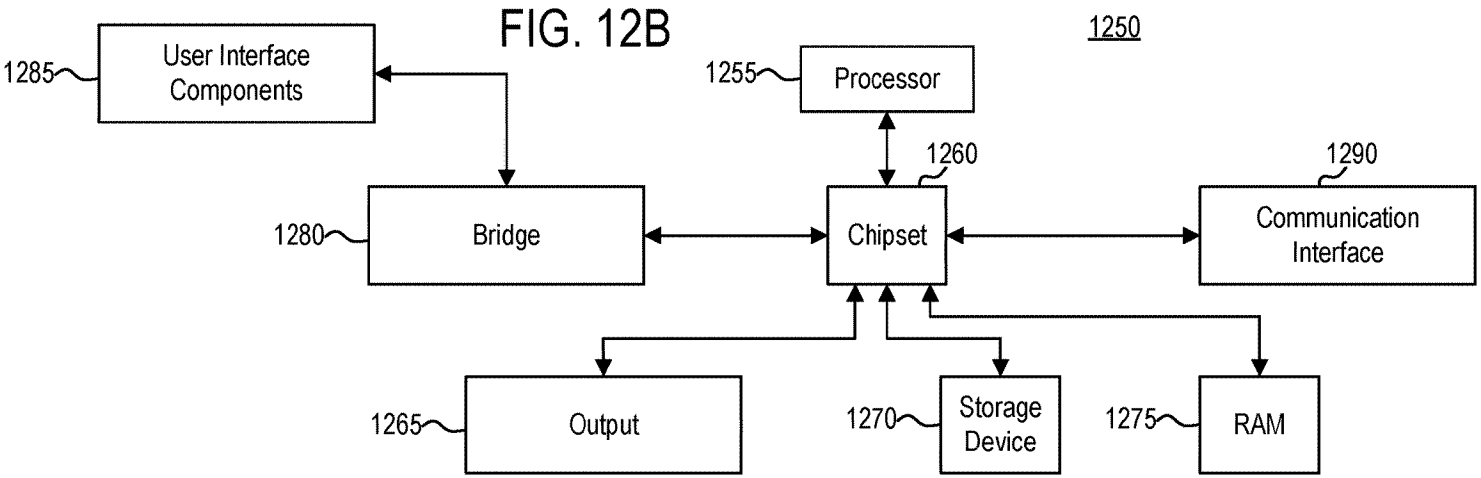
FIG. 12B illustrates a computer system having a chipset architecture, according to example embodiments.

FIG. 12B illustrates a computer system 1250 having a chipset architecture that may represent at least a portion of organization computing system 104. Computer system 1250 may be an example of computer hardware, software, and firmware that may be used to implement the disclosed technology. System 1250 may include a processor 1255, representative of any number of physically and/or logically distinct resources capable of executing software, firmware, and hardware configured to perform identified computations. Processor 1255 may communicate with a chipset 1260 that may control input to and output from processor 1255. In this example, chipset 1260 outputs information to output 1265, such as a display, and may read and write information to storage device 1270, which may include magnetic media, and solid-state media, for example. Chipset 1260 may also read data from and write data to RAM 1275. A bridge 1280 for interfacing with a variety of user interface components 1285 may be provided for interfacing with chipset 1260. Such user interface components 1285 may include a keyboard, a microphone, touch detection and processing circuitry, a pointing device, such as a mouse, and so on. In general, inputs to system 1250 may come from any of a variety of sources, machine generated and/or human generated.

Chipset 1260 may also interface with one or more communication interfaces 1290 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 1255 analyzing data stored in storage device 1270 or RAM 1275. Further, the machine may receive inputs from a user through user interface components 1285 and execute appropriate functions, such as browsing functions by interpreting these inputs using processor 1255.

It may be appreciated that example systems 1200 and 1250 may have more than one processor 1210 or be part of a group or cluster of computing devices networked together to provide greater processing capability.

While the foregoing is directed to embodiments described herein, other and further embodiments may be devised without departing from the basic scope thereof. For example, aspects of the present disclosure may be implemented in hardware or software or a combination of hardware and software. One embodiment described herein may be implemented as a program product for use with a computer system. The program(s) of the program product define functions of the embodiments (including the methods described herein) and can be contained on a variety of computer-readable storage media. Illustrative computer-readable storage media include, but are not limited to: (i) non-writable storage media (e.g., read-only memory (ROM) devices within a computer, such as CD-ROM disks readably by a CD-ROM drive, flash memory, ROM chips, or any type of solid-state non-volatile memory) on which information is permanently stored; and (ii) writable storage media (e.g., floppy disks within a diskette drive or hard-disk drive or any type of solid state random-access memory) on which alterable information is stored. Such computer-readable storage media, when carrying computer-readable instructions that direct the functions of the disclosed embodiments, are embodiments of the present disclosure.

It will be appreciated to those skilled in the art that the preceding examples are exemplary and not limiting. It is intended that all permutations, enhancements, equivalents, and improvements thereto are apparent to those skilled in the art upon a reading of the specification and a study of the drawings are included within the true spirit and scope of the present disclosure. It is therefore intended that the following appended claims include all such modifications, permutations, and equivalents as fall within the true spirit and scope of these teachings.

The invention claimed is:

1. A method comprising:

identifying, by a computing system, data related to a tennis match between a first player and a second player, the data comprising a current match state and a current in-match performance;

generating, by the computing system, an input data set comprising the data related to the tennis match, the generating comprising modifying the current match state to assume that the first player will win a next point in the tennis match;

based on the input data set, measuring, by the computing system, an importance of the next point to the first player winning the tennis match by:

predicting, by the computing system, a first outcome of a current game based on the input data set;

predicting, by the computing system, a second outcome of a current set based on the input data set and the predicted first outcome of the current game; and predicting, by the computing system, a third outcome of the tennis match based on the input data set, the predicted first outcome of the current game, and the predicted second outcome of the current set;

generating, by the computing system, a graphical representation indicating the importance of the next point; and overlaying, by the computing system, the graphical representation over a broadcast video feed of the tennis match.

2. The method of claim 1, further comprising:

generating, by the computing system, a momentum of the first player based on the measured importance of the next point to the first player winning the tennis match.

3. The method of claim 2, wherein generating, by the computing system, the momentum of the first player based on the measured importance of the next point to the first player winning the tennis match comprises:

identifying gained leverages of the first player over a previous number of points; and generating a weighted moving average of the gained leverages.

4. The method of claim 2, further comprising:

overlaying, by the computing system, a generated momentum graphical representation of the generated momentum over the broadcast video feed of the tennis match.

5. The method of claim 1, further comprising:

generating, by the computing system, a clutch metric for the first player based on the importance of the next point.

6. The method of claim 5, wherein generating, by the computing system, the clutch metric for the first player based on the importance of the next point comprises:

determining that the next point has greater than a threshold effect on the predicted third outcome of the tennis match.

7. The method of claim 1, further comprising:

overlaying, by the computing system, a current win probability graphical representation of a current win probability of the first player over the broadcast video feed of the tennis match.

8. The method of claim 1, further comprising:

determining, by the computing system, that the next point meets a threshold level of importance.

9. The method of claim 1, further comprising:

determining, by the computing system, a win probability of the first player;

generating, by the computing system, a win probability graphical representation comprising the win probability; and overlaying, by the computing system, the graphical representation over the broadcast video feed of the tennis match.

10. A non-transitory computer readable medium having one or more sequences of instructions stored thereon, which, when executed by a processor, causes a computing system to perform operations comprising:

identifying, by the computing system, data related to a tennis match between a first player and a second player, the data comprising a current match state and a current in-match performance;

generating, by the computing system, an input data set comprising the data related to the tennis match, the generating comprising modifying the current match state to assume that the first player will win a next point in the tennis match;

based on the input data set, measuring, by the computing system, an importance of the next point to the first player winning the tennis match by:

predicting, by the computing system, a first outcome of a current game based on the input data set, predicting, by the computing system, a second outcome of a current set based on the input data set and the predicted first outcome of the current game, and predicting, by the computing system, a third outcome of the tennis match based on the input data set, the predicted first outcome of the current game, and the predicted second outcome of the current set;

generating, by the computing system, a graphical representation indicating the importance of the next point; and overlaying, by the computing system, the graphical representation over a broadcast video feed of the tennis match.

11. The non-transitory computer readable medium of claim 10, further comprising:

generating, by the computing system, a momentum of the first player based on the measured importance of the next point to the first player winning the tennis match.

12. The non-transitory computer readable medium of claim 11, wherein generating, by the computing system, the momentum of the first player based on the measured importance of the next point to the first player winning the tennis match comprises:

identifying gained leverages of the first player over a previous number of points; and generating a weighted moving average of the gained leverages.

13. The non-transitory computer readable medium of claim 11, further comprising:

overlaying, by the computing system, a graphical representation of the generated momentum over a broadcast video feed of the tennis match.

14. The non-transitory computer readable medium of claim 10, further comprising:

generating, by the computing system, a clutch metric for the first player based on the importance of the next point.

15. The non-transitory computer readable medium of claim 14, wherein generating, by the computing system, the clutch metric for the first player based on the importance of the next point comprises:

determining that the next point has greater than a threshold effect on the predicted third outcome of the tennis match.

16. The non-transitory computer readable medium of claim 10, further comprising:

overlaying, by the computing system, a current win probability graphical representation of a current win probability of the first player over the broadcast video feed of the tennis match.

17. A system comprising:

a processor; and a memory having programming instructions stored thereon, which, when executed by the processor, causes the system to perform operations comprising:

identifying data related to a tennis match between a first player and a second player, the data comprising a current match state and a current in-match performance;

generating an input data set comprising the data related to the tennis match, the generating comprising modifying the current match state to assume that the first player will win a next point in the tennis match;

based on the input data set, measuring an importance of the next point to the first player winning the tennis match by:

predicting a first outcome of a current game based on the input data set, predicting a second outcome of a current set based on the input data set and the predicted first outcome of the current game, and predicting a third outcome of the tennis match based on the input data set, the predicted first outcome of the current game, and the predicted second outcome of the current set;

generating a graphical representation indicating the importance of the next point; and overlaying the graphical representation over a broadcast video feed of the tennis match.

18. The system of claim 17, wherein the operations further comprise:

generating a momentum of the first player based on the measured importance of the next point to the first player winning the tennis match, the generating comprising:

identifying gained leverages of the first player over a previous number of points; and generating a weighted moving average of the gained leverages.

19. The system of claim 18, wherein the operations further comprise:

overlaying a generated momentum graphical representation of the generated momentum over the broadcast video feed of the tennis match.

20. The system of claim 17, wherein the operations further comprise:

generating a clutch metric for the first player based on the importance of the next point, the generating comprising:

determining that the next point has greater than a threshold effect on the predicted third outcome of the tennis match.

* * * * *